US011731811B2

(12) United States Patent
Nie

(10) Patent No.: US 11,731,811 B2
(45) Date of Patent: Aug. 22, 2023

(54) DISPOSABLE LUNCH BOX

(71) Applicant: JIANGMEN CITY XINHUI HENGLONG INNOVATIVE HOUSEWARES CO., LTD., Jiangmen (CN)

(72) Inventor: Huayao Nie, Jiangmen (CN)

(73) Assignee: JIANGMEN CITY XINHUI HENGLONG INNOVATIVE HOUSEWARES CO., LTD., Jiangmen (CN)

( * ) Notice: Subject to any disclaimer, the term of this patent is extended or adjusted under 35 U.S.C. 154(b) by 160 days.

(21) Appl. No.: 17/215,116

(22) Filed: Mar. 29, 2021

(65) Prior Publication Data

US 2022/0273082 A1 Sep. 1, 2022

(30) Foreign Application Priority Data

Mar. 1, 2021 (CN) ..... 202110223443.7

(51) Int. Cl.
*B65D 43/02* (2006.01)
*A45C 11/20* (2006.01)
(Continued)

(52) U.S. Cl.
CPC ..... *B65D 43/0212* (2013.01); *A45C 11/20* (2013.01); *A45C 13/1076* (2013.01); *B65D 47/36* (2013.01)

(58) Field of Classification Search
CPC .... B65D 77/30; B65D 47/36; B65D 43/0243; B65D 43/0212; B65D 2543/00537;
(Continued)

(56) References Cited

U.S. PATENT DOCUMENTS 5,027,969 A * 7/1991 Lesquir ..... B65D 43/0212 220/270
5,788,105 A * 8/1998 Foos ..... B65D 75/22 206/469
(Continued)

FOREIGN PATENT DOCUMENTS

JP 1996244812 A 9/1986
JP 1995040488 7/1995
(Continued)

*Primary Examiner* — James N Smalley
*Assistant Examiner* — Madison L Poos
(74) *Attorney, Agent, or Firm* — Caldwell Intellectual Property Law

(57) ABSTRACT

Disclosed is a disposable lunch box, which includes an upper cover and a bottom box, the upper cover includes a cover body and a first clamping part connected with the cover body, the bottom box includes a box body and a second clamping part connected with the box body, the first clamping part and the second clamping part are configured for assembling the upper cover and the bottom box together. An easily broken rib is arranged between the cover body and the first clamping part, and an easily broken edge is arranged between the box body and the second clamping part, or the easily broken edge is arranged between the cover body and the first clamping part, and the easily broken rib is arranged between the box body and the second clamping part.

16 Claims, 5 Drawing Sheets

(51) Int. Cl.
*A45C 13/10* (2006.01)
*B65D 47/36* (2006.01)

(58) Field of Classification Search
CPC ..... B65D 2543/00518; B65D 2543/00296; B65D 2543/00101; B65D 2401/15; B65D 2401/10; B65D 1/40; B65D 1/34; A45C 13/1076; A45C 11/20
USPC ..... 220/4.21, 270, 265
See application file for complete search history.

(56) References Cited

U.S. PATENT DOCUMENTS

| | | | | |
|---|---|---|---|---|
| 2006/0213800 | A1* | 9/2006 | Ballard | B65D 43/162 229/407 |
| 2015/0028033 | A1* | 1/2015 | Samuel | B65D 43/162 220/270 |
| 2017/0057706 | A1* | 3/2017 | Wang | B65D 43/0254 |

FOREIGN PATENT DOCUMENTS

| | | | |
|---|---|---|---|
| JP | 1995040489 | | 7/1996 |
| JP | 2003252358 | A | 9/2003 |
| JP | 2004042957 | A | 2/2004 |
| KR | 200483289 | Y1 | 4/2017 |

* cited by examiner

DISPOSABLE LUNCH BOX

CROSS-REFERENCE TO RELATED APPLICATIONS

This application claims the benefit of priority of Chinese patent application No. 202110223443.7 filed Mar. 1, 2021, the entire contents of which are incorporated herein by reference.

FIELD OF THE INVENTION

The present invention generally relates to the field of food packaging boxes. In particular, the present invention is directed to a disposable lunch box.

BACKGROUND

With the quickening pace of people's life and the development of catering industry, ordering take-out has become the norm, and disposable lunch boxes are extremely widely used. However, the disposable lunch box for take-out may be opened by others during delivery, which is difficult to be found out by a consumer.

SUMMARY OF THE DISCLOSURE

In an aspect, the present disclosure aims to solve at least one of the technical problems in the existing technology. Therefore, the present disclosure provides a disposable lunch box, which is capable of preventing the lunch box from being opened by other people during food delivery and facilitates opening before dining.

A disposable lunch box according to an embodiment of the present disclosure includes an upper cover and a bottom box. Upper cover includes a cover body and a first clamping part connected with the cover body. Bottom box includes a box body and a second clamping part connected with the box body. First clamping part and second clamping part are configured for assembling upper cover and bottom box together. An easily broken rib may be arranged between cover body and first clamping part, and an easily broken edge may be arranged between box body and second clamping part. Alternatively easily broken edge may be arranged between cover body and first clamping part, and easily broken rib may be arranged between box body and second clamping part.

Disposable lunch box may have at least the following beneficial effects. After upper cover and bottom box are assembled and closed through first clamping part and second clamping part, lunch box may be possible to open only by pressing the first clamping part and/or the second clamping part to break easily broken rib, so that whether lunch box is opened may be judged before dining, so as to play a role alert a customer to the opening and ensure safety of dining. In addition, due to existence of easily broken edge, first clamping part and/or second clamping part may be turned over to an opposite side and stay on the opposite side while breaking easily broken rib, which may facilitate opening without generating extra garbage.

According to some embodiments of the present disclosure, cover body may be provided with a first notch which may be configured to accommodate first clamping part.

By arranging first notch in box body for accommodating first clamping part, first clamping part may be protected so as to avoid breakage of easily broken rib caused by accidental touch and reduce overall volume at the same time.

According to some embodiments of the present disclosure, cover body may be provided with a baffle extending along an outer contour of the cover body and cooperating to form first notch.

Strength of first notch may be increased by arranging a baffle on an outer contour of cover body and forming the first notch by cooperating with the baffle at the same time, so that separation or turnover of first clamping part from the cover body will not affect integrity of other positions of the cover body.

According to some embodiments of the present disclosure, first clamping part may be provided with a first base plate and a first vertical plate connected with the first base plate; the first base plate may be configured to snap-fit with second clamping part.

By providing first clamping part with first base plate first clamping part and/or first base plate may be snap-fitted with second clamping part. Provision of first clamping part with first vertical plate may be beneficial for exertion of human hands when first clamping part is separated and/or turned over from cover body, so as to facilitate operation.

According to some embodiments of the present disclosure, easily broken rib may be arranged between at least one of first base plate and first vertical plate and cover body.

By arranging easily broken rib on first base plate of first clamping part, cover body may be removable only by pressing first clamping part to break easily broken rib before dining, which facilitates use. Moreover, by arranging easily broken rib on first vertical plate, connection strength between first clamping part and cover body may be improved, so as to avoid accidental disconnection.

According to some embodiments of the present disclosure, first base plate may be provided with a buckle, and second clamping part may be provided with a gap matched with the buckle.

In some embodiments, it may be impossible or impractical to open lunch box after being closed, where buckle of first base plate is matched with the gap of the second clamping part, and the lunch box may be openable only by breaking easily broken rib, thus preventing the lunch box from being opened by other people during food delivery, alerting consumers to tampering and ensuring safe dining.

According to some embodiments of the present disclosure, box body may be provided with a second notch which may be configured to accommodate second clamping part.

By arranging second notch in box body for accommodating second clamping part, space may be saved while facilitating appearance.

According to some embodiments of the present disclosure, easily broken edge may be arranged on one side of second clamping part and second notch may be placed close to a center of box body.

Easily broken edge may be arranged on one side of second clamping part and second notch close to a center of box body, so that the second clamping part may be turned over inwardly from outside lunch box, which may accord with use habits of human hands; meanwhile, the second clamping part may cling to a side face of box body after being turned over, so that dining is not affected.

According to some embodiments of present disclosure, a first rib may be arranged between second clamping part and second notch.

Arrangement of first rib may play a role of assisting in fixing second clamping part, which may be beneficial for preventing the second clamping part from being turned over during closing, which may permit the second clamping part to be turned over along easily broken edge only when easily broken rib of first clamping part is broken along with first rib.

According to some embodiments of the present disclosure, easily broken edge may have a U-shaped cross section.

Easily broken edge with U-shaped cross section may guide a turnover process of second clamping part while reducing force for turnover.

These and other aspects and features of non-limiting embodiments of the present invention will become apparent to those skilled in the art upon review of the following description of specific non-limiting embodiments of the invention in conjunction with the accompanying drawings.

BRIEF DESCRIPTION OF THE DRAWINGS

The above and/or additional aspects and advantages of the present disclosure will be apparent and easily understood from the description of the embodiments with reference to the following accompanying drawings, wherein.

Figure 1:
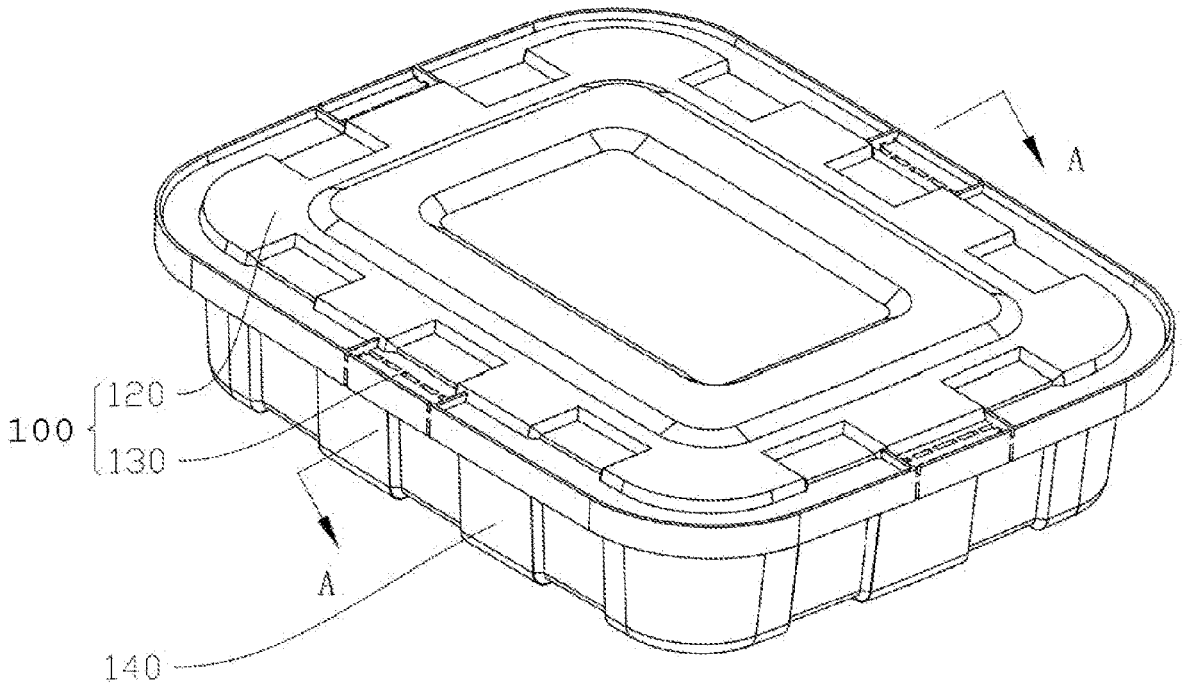
FIG. 1 is a schematic structural diagram of an exemplary embodiment of a disposable lunch box.

The drawings are not necessarily to scale and may be illustrated by phantom lines, diagrammatic representations and fragmentary views. In certain instances, details that are not necessary for an understanding of the embodiments or that render other details difficult to perceive may have been omitted.

DETAILED DESCRIPTION

The embodiments of the present disclosure are described in detail hereinafter. Examples of the embodiments are shown in the accompanying drawings. The same or similar reference numerals throughout the accompanying drawings denote the same or similar elements or elements having the same or similar functions. The embodiments described hereinafter with reference to the accompanying drawings are exemplary and are only used to explain the present disclosure but should not be understood as limiting the present disclosure.

In the description of the present disclosure, it should be understood that the orientation or position relationship indicated by the terms "up", "down", "front", "rear", "left", "right", and the like is based on the orientation or position relationship shown in the accompanying drawings, it is only for the convenience of description of the present disclosure and simplification of the description, and it is not to indicate or imply that the indicated device or element must have a specific orientation, and be constructed and operated in a specific orientation. Therefore, the terms shall not be understood as limiting the present disclosure.

In the description of the disclosure, "certain" means one or more, "a plurality of" means two or more, and "greater than", "less than", "more than", etc. are understood as excluding the number itself, "above", "below", "within", etc. are understood as including the number itself. "First", "second", etc., if referred to, are for the purpose of distinguishing technical features only, cannot be understood as indicating or implying a relative importance or implicitly indicating the number of technical features indicated or implicitly indicating the precedence of technical features indicated In the description of the present disclosure, it shall be noted that the terms "installation", "connected" and "connection" if any shall be understood in a broad sense unless otherwise specified and defined. For example, they may be fixed connection, removable connection or integrated connection; may be mechanical connection or electrical connection; and may be direct connection, or indirect connection through an intermediate medium, and connection inside two elements. The specific meanings of the above terms in the present disclosure can be understood in a specific case by those of ordinary skills in the art.

A disposable lunch box according to an embodiment of the present disclosure is described hereinafter with reference to the accompanying drawings.

Figure 2:
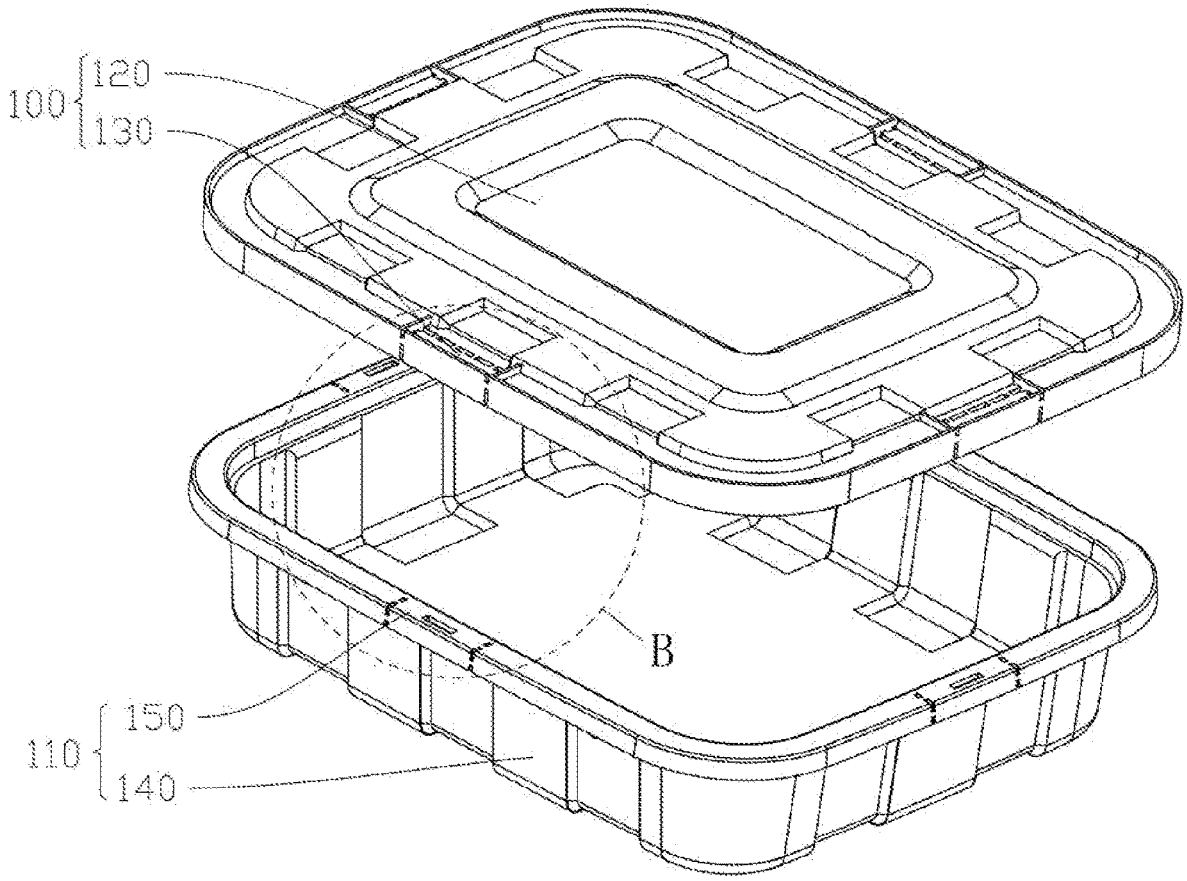
FIG. 2 is an exploded view of an exemplary embodiment of a disposable lunch box.
Figure 3:
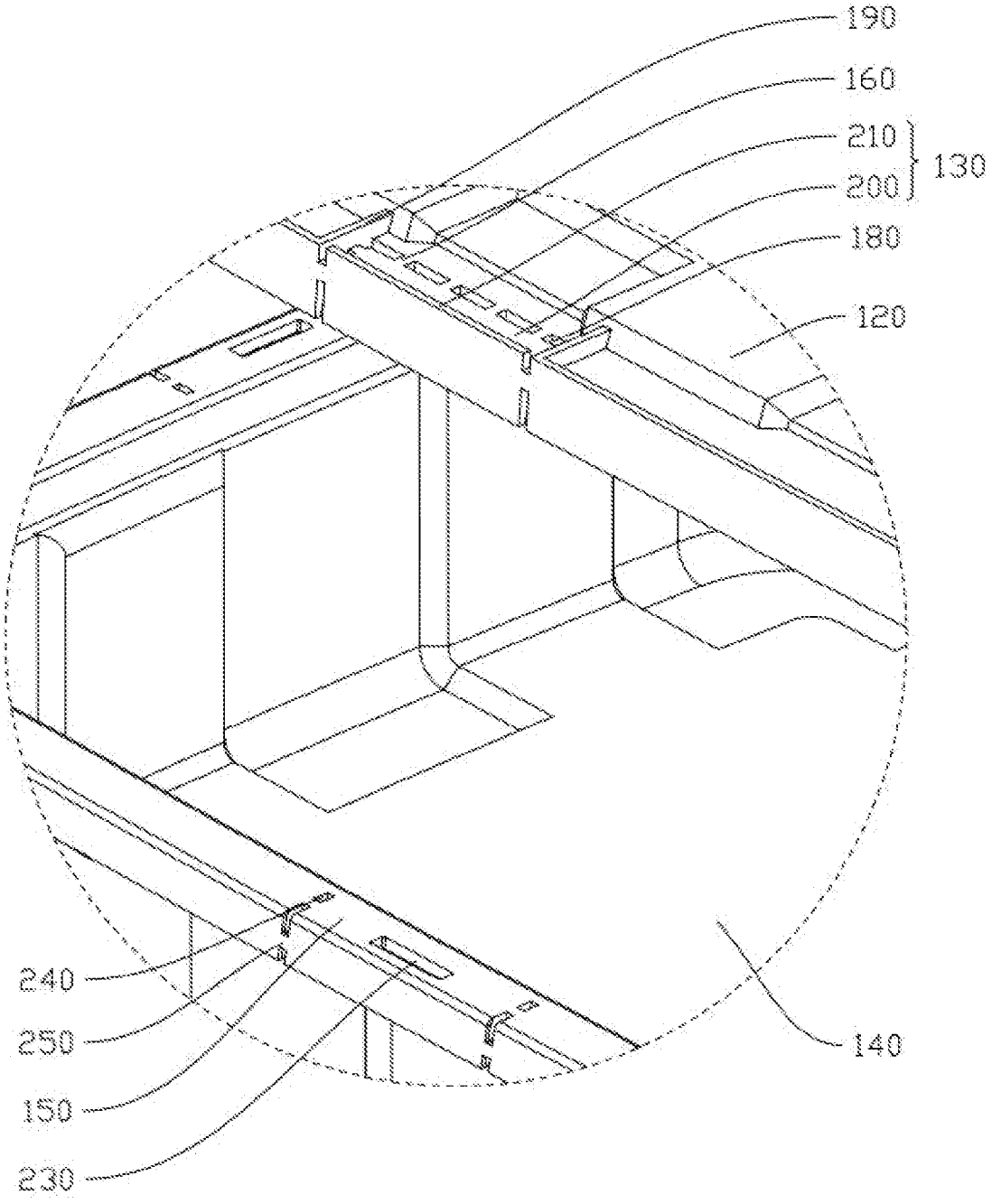
FIG. 3 is an enlarged view of a detail of an exemplary embodiment of a disposable lunch box.
Figure 4:
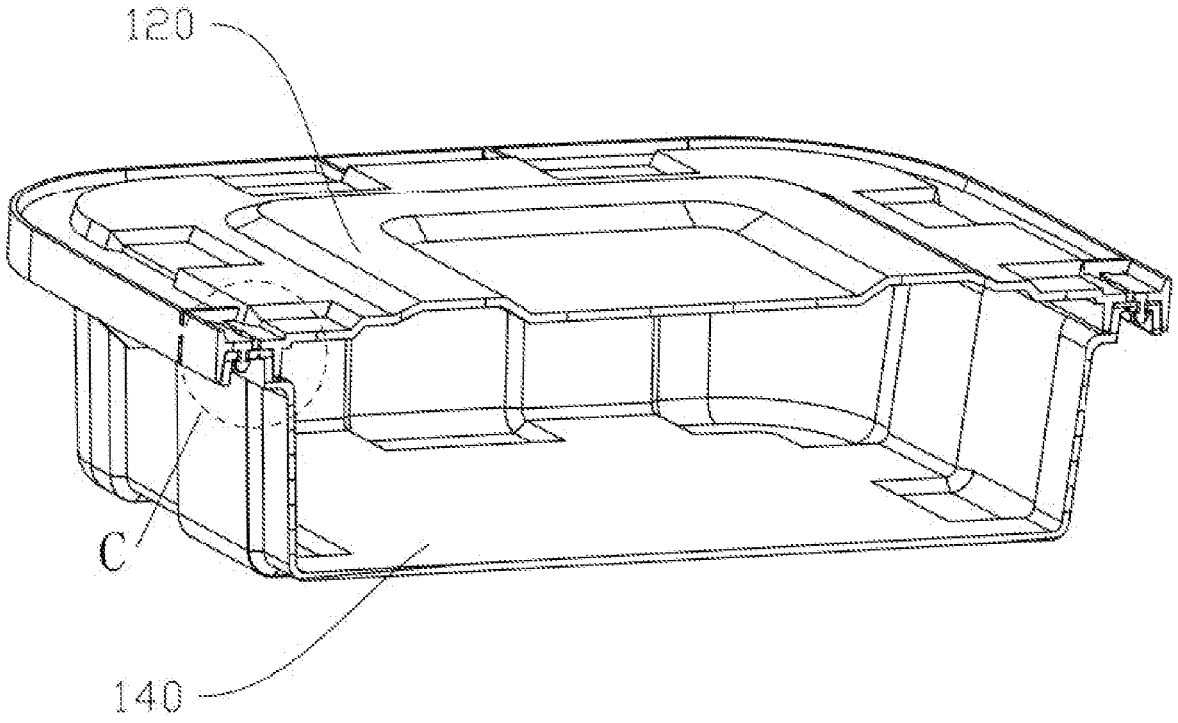
FIG. 4 is a sectional view along line A-A in FIG. 1.
Figure 5:
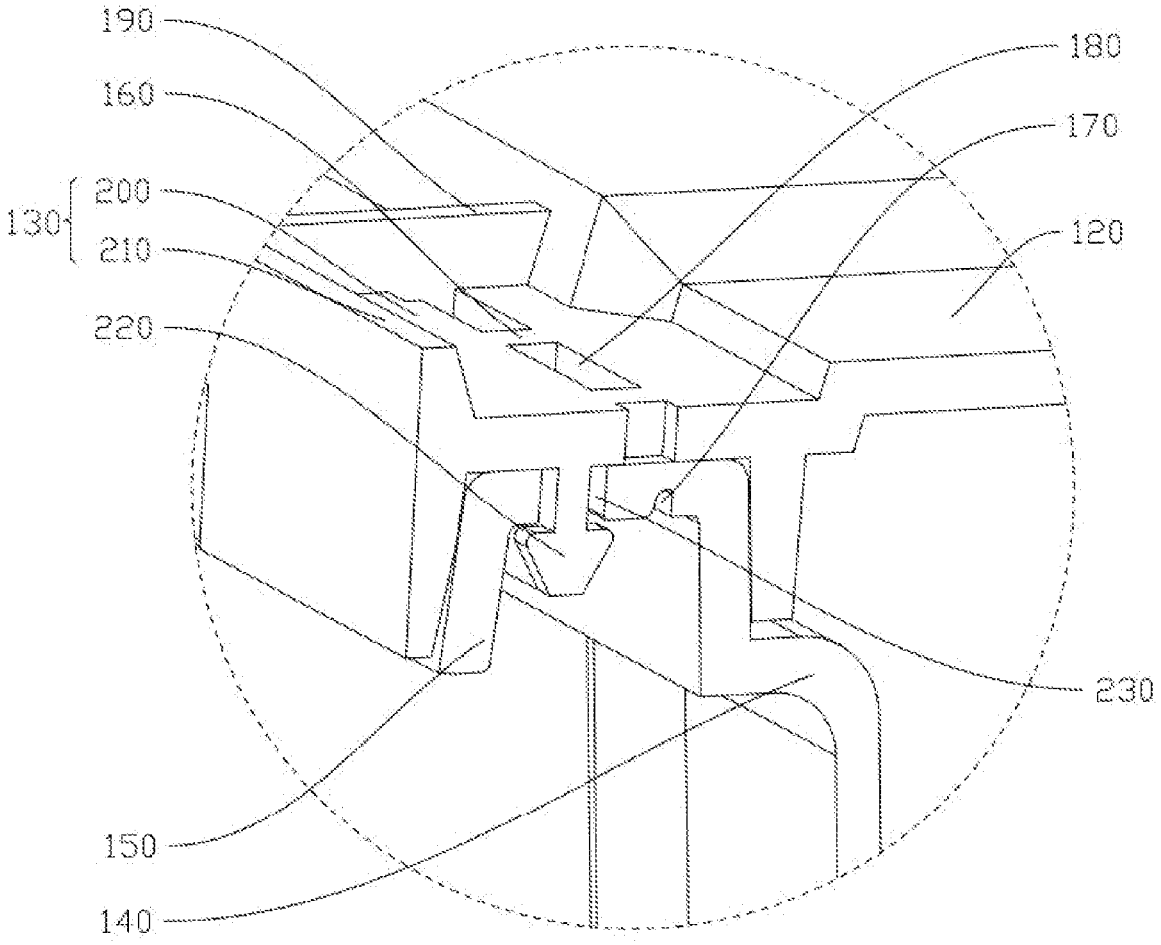
FIG. 5 is an enlarged view of a detail of an exemplary embodiment of a disposable lunch box.

With reference to FIG. 1 to FIG. 5, a disposable lunch box according to an embodiment of the present disclosure includes an upper cover 100 and a bottom box 110.

Upper cover 100 includes a cover body 120 and a first clamping part 130 connected with the cover body 120. Bottom box 110 includes a box body 140 and a second clamping part 150 connected with the box body 140. First clamping part 130 and second clamping part 140 are configured for assembling upper cover 100 and bottom box 110 together. An easily broken rib 160 may be arranged between cover body 120 and first clamping part 130. An easily broken edge 170 may be arranged between box body 140 and second clamping part 150. Alternatively, easily broken edge 170 may be arranged between cover body 120 and first clamping part 130. Easily broken rib 160 may be arranged between box body 140 and second clamping part 150. Certainly, it does not mean that the easily broken rib 160 cannot be arranged in case that the easily broken edge 170 is arranged, and the easily broken rib 160 may be arranged after the easily broken edge 170 is arranged for one of the first clamping part 130 and the second clamping part 150.

After upper cover 100 and bottom box 110 are assembled and closed using first clamping part 130 and second clamping part 150, lunch box may be opened only by pressing first clamping part 130 and/or second clamping part 150 to break easily broken rib 160, so that whether the lunch box has ever been opened may be judged before dining; this may function to alert a customer when the lunch box has been opened and may aid in ensuring safety in dining. In addition, due to existence of easily broken edge 170, first clamping part 130 and/or second clamping part 150 may be turned over to an opposite side and stay on the opposite side while breaking easily broken rib 160, which may facilitate opening without generating extra garbage.

In some embodiments of the present disclosure, cover body 120 may be provided with a first notch 180, which may be configured to accommodate first clamping part 130. First clamping part 130 may be protected by arranging first notch 180 in box body 140 for accommodating first clamping part 130, so as to avoid breakage of easily broken rib 160 caused by accidental touch while reducing an overall volume of lunch box.

In addition, cover body 120 may be provided with a baffle 190. Baffle 190 may extend along an outer contour of cover body 120. Baffle 190 cooperates to form first notch 180. The strength of first notch 180 may be increased by arranging baffle 190 on an outer contour of cover body 120 and forming first notch 180 by cooperating with the baffle 190 at the same time, so that separation or turnover of first clamping part 130 from the cover body 120 may not affect integrity of other positions of the cover body 120.

In some embodiments, first clamping part 130 may be provided with a first base plate 200 and/or a first vertical plate 210 connected with the first base plate 200. First base plate 200 may be configured to snap-fit with second clamping part 150. By providing first clamping part 130 with first base plate 200, first clamping part may be able to be snap-fitted with second clamping part 150. Provision of first clamping part 130 with first vertical plate 210, may reduce exertion of human hands when first clamping part is separated and/or turned over from cover body 120, so as to facilitate operation.

In some embodiments, easily broken rib 160 may be arranged between first base plate 200 and/or first vertical plate 210 and cover body 120. By arranging easily broken rib 160 on first base plate 200 of first clamping part 130, cover body 120 may be removable only by pressing the first clamping part 130 to break the easily broken rib 160 before dining, which may facilitate use. Moreover, by arranging easily broken rib 160 on first vertical plate 210, connection strength between first clamping part 130 and cover body 120 may be improved, so as to avoid accidental disconnection.

Meanwhile, first base plate 200 may be provided with a buckle 220. Second clamping part 150 may be provided with a gap 230 matched with buckle 220. Lunch box may be rendered impossible or impractical to open after being closed by matching buckle 220 of first base plate 200 with gap 230 of second clamping part 150, such that the lunch box may as a practical matter be opened only by breaking easily broken rib 160; this may prevent the lunch box from being opened by other people during food delivery, alerting consumers to an opened lunchbox and ensuring safety of dining.

In some embodiments of the present disclosure, box body 140 may be provided with a second notch 240 which may be configured to accommodate second clamping part 150. By arranging second notch 240 on box body 140 for accommodating second clamping part 150, space may be saved while facilitating appearance of lunch box.

In addition, easily broken edge 170 may be arranged on one side of second clamping part 150 and second notch 240 close to a center of box body 140. Easily broken edge 170 may be arranged on one side of second clamping part 150 and second notch 240 close to center of the box body 140, so that the second clamping part 150 may be turned over inwardly from an outside of lunch box, in accordance with use habits of human hands. Second clamping part 150 may cling to a side face of box body 140 after being broken, so that dining is not affected.

In some embodiments, a first rib 250 may be arranged between second clamping part 150 and second notch 240. Arrangement of first rib 250 may play a role of assisting in fixing second clamping part 150, which may be beneficial for preventing the second clamping part 150 from being turned over during closing; in an embodiment, second clamping part may be able to be turned over along easily broken edge 170 only when easily broken rib 160 of first clamping part 130 is broken and first rib 250 broken as well.

In some embodiments, easily broken edge 170 may have a U-shaped cross section. An easily broken edge 170 with U-shaped cross section may guide a turnover process of second clamping part 150 while reducing force required for turnover.

In the description of this specification, the terms "one embodiment", "some embodiments" "illustrative embodiments", "examples", "specific examples", or "some examples", or the like, mean that specific features, structures, materials, or features described in connection with the embodiment or example are included in at least one embodiment or example of the present disclosure. In this specification, illustrative expression of the above terms do not necessarily refer to the same embodiment or example. Moreover, the specific features, structures, materials, or features described may be incorporated in any one or more embodiments or examples in a suitable manner The embodiments of the present disclosure are described in detail with reference to the accompanying drawings above, but the present disclosure is not limited to the above embodiments, and various changes may also be made within the knowledge scope of those of ordinary skills in the art without departing from the purpose of the present disclosure.

What is claimed is:

1. A disposable lunch box, comprising:

an upper cover, the upper cover comprising:

a cover body; and a first clamping part connected with the cover body, wherein the first clamping part comprises a first base, the first base comprising a buckle; and a bottom box, the bottom box comprising:

a box body; and a second clamping part connected with the box body, wherein the second clamping part comprises a gap;

wherein:

the first clamping part and the second clamping part are configured for assembling the upper cover and the bottom box together;

an easily broken rib is arranged between the cover body and the first clamping part;

an easily broken edge is arranged between the box body and the second clamping part;

the gap and the buckle are configured to match, wherein matching the buckle and the gap prevents the disposable lunch box from being opened without breaking the easily broken edge; and wherein the easily broken edge is arranged between the cover body and the first clamping part, and the easily broken rib is arranged between the box body and the second clamping part, wherein the easily broken edge comprises a U-shaped cross section.

2. The disposable lunch box of claim 1, wherein the cover body further comprises a first notch wherein the first notch is configured to accommodate the first clamping part.

3. The disposable lunch box of claim 2, wherein the cover body further comprises a baffle extending along an outer contour of the cover body and cooperating to form the first notch.

4. The disposable lunch box of claim 1, wherein the first clamping part further comprises:

a first base plate; and a first vertical plate connected with the first base plate, wherein the first base plate is configured to snap-fit with the second clamping part.

5. The disposable lunch box of claim 4, wherein the easily broken rib is arranged between at least one of the first base plate, the first vertical plate and the cover body.

6. The disposable lunch box of claim 1, wherein the box body further comprises a second notch, wherein the second notch is configured to accommodate the second clamping part.

7. The disposable lunch box of claim 6, wherein:

the easily broken edge is arranged on one side of the second clamping part; and the second notch is located close to a center of the box body.

8. The disposable lunch box of claim 7, wherein a first rib is arranged between the second clamping part and the second notch.

9. A disposable lunch box, comprising:

an upper cover, the upper cover comprising:

a cover body; and a first clamping part connected with the cover body, wherein the first clamping part comprises a first base, the first base comprising a buckle; and a bottom box, the bottom box comprising:

a box body; and a second clamping part connected with the box body, wherein the second clamping part comprises a gap;

wherein:

the first clamping part and the second clamping part are configured for assembling the upper cover and the bottom box together;

an easily broken edge is arranged between the cover body and the first clamping part, wherein the easily broken edge comprises a U-shaped cross section;

the gap and the buckle are configured to match, wherein matching the buckle and the gap prevents the disposable lunch box from being opened without breaking the easily broken edge; and an easily broken rib is arranged between the box body and the second clamping part.

10. The disposable lunch box of claim 9, wherein the cover body further comprises a first notch wherein the first notch is configured to accommodate the first clamping part.

11. The disposable lunch box of claim 10, wherein the cover body further comprises a baffle extending along an outer contour of the cover body and cooperating to form the first notch.

12. The disposable lunch box of claim 9, wherein the first clamping part further comprises:

a first base plate; and a first vertical plate connected with the first base plate, wherein the first base plate is configured to snap-fit with the second clamping part.

13. The disposable lunch box of claim 12, wherein the easily broken rib is arranged between at least one of the first base plate, the first vertical plate and the cover body.

14. The disposable lunch box of claim 9, wherein the box body further comprises a second notch, wherein the second notch is configured to accommodate the second clamping part.

15. The disposable lunch box of claim 14, wherein:

the easily broken edge is arranged on one side of the second clamping part; and the second notch is located close to a center of the box body.

16. The disposable lunch box of claim 15, wherein a first rib is arranged between the second clamping part and the second notch.

* * * * *